United States Patent [19]

Schriber et al.

[11] 4,131,047

[45] Dec. 26, 1978

[54] ROTARY KNIFE MOUNTING

[75] Inventors: Louis Schriber; John F. Blaha, both of Dayton, Ohio

[73] Assignee: Harris Corporation, Cleveland, Ohio

[21] Appl. No.: 781,838

[22] Filed: Mar. 28, 1977

[51] Int. Cl.[2] ..... B26D 1/40; B26D 4/72

[52] U.S. Cl. ..... 83/698; 83/356.3; 144/230

[58] Field of Search ..... 83/698, 355, 356.3; 144/230; 29/105 R; 407/49, 50

[56] References Cited

U.S. PATENT DOCUMENTS

| | | | |
|---|---|---|---|
| 1,611,298 | 12/1926 | Wilderson | 144/230 |
| 2,751,006 | 6/1956 | Lane | 83/698 X |
| 3,865,164 | 2/1975 | Sybertz | 83/698 X |
| 3,989,077 | 11/1976 | Humbert | 144/230 |

*Primary Examiner*—Willie G. Abercrombie

*Attorney, Agent, or Firm*—Biebel, French & Nauman

[57] ABSTRACT

An improved knife mounting arrangement is provided for a rotary cutter or perforator having a cutter cylinder with a longitudinally extending slot and a knife blade located in said slot. The back edge of the blade is spaced from the bottom of the slot and the cutting edge of the blade protrudes from the slot. A wedging member is fitted in the slot to clamp the blade in a seated position to cooperate with an external anvil. Preloading springs act on the wedging member with a force sufficient to retain the blade during mounting and seating operations, while allowing limited movement of the knife blade into the slot. Holding bolts act on the wedging member in addition to the preloading springs to secure the position of the knife blade after it is seated against an anvil.

5 Claims, 9 Drawing Figures

ROTARY KNIFE MOUNTING

BACKGROUND OF THE INVENTION

This invention relates to a means for mounting and accurately seating a rotary cutting or perforating knife such as might be used to sever, completely or partially, a web at a plurality of locations along its length. One of the requirements for such knife mounting arrangements is that the cutting edge of the knife be capable of accurate seating against an anvil surface. For example, a back-up or anvil cylinder may be provided with a hardened surface, or insert, or in some cases a die, to cooperate with the sharpened edge of the knife in severing the passing web as the web moves between the rotating knife cylinder and anvil or back-up cylinder.

It has been known for many years that the knife can be accurately clamped in a slot in a rotary cutter cylinder by using various forms of wedging devices. For example, one side of the slot will be machined non-parallel to the opposite side of the slot, and one or more wedging bars are fitted into such slot, and drawn inward, as by a plurality of clamp screws or bolts, thereby exerting a sidewise clamping or wedging action against the knife blade. The blade may be clamped against one of the side faces of the slot, or against an intermediate supporting bar, in accordance with various prior art practices.

In some instances the knife blade itself has been slotted, or drilled, in order to provide passage for clamping screws which act through an intermediary clamping bar to clamp the blade against a seating or supporting side surface within the mounting slot. The slot for receiving the knife blade may be machined within a surface of a rotary cutter cylinder, or may be incorporated as part of a built up mounting structure, mounted on a smaller diameter cylinder or a skeleton cylinder arrangement. In any event, the procedure for mounting and "seating in" the knife blade requires that the blade be fitted into the slot or other supporting structure, and clamped somewhat loosely throughout its length, such that the knife can move into the slot in any or all of the locations along the slot as the knife is seated against the anvil surface (or against the die). Once the knife blade is seated in, it is then necessary to tighten all of the clamping structure to be sure that the blade is securely clamped throughout its length for the ensuing run of the apparatus. p Prior art patents which show these arrangements in various combinations and modifications are U.S. Pat. Nos. 2,660,242; 2,751,006, 3,073,196; 3,084,582; 3,086,416; 3,166,965; 3,264,921; 3,555,948; 3,709,077; 3,733,949; 3,771,399; and 3,793,918.

SUMMARY OF THE INVENTION

The present invention provides a novel arrangement for clamping a blade to a rotary cutter cylinder wherein the blade is easily inserted and held in place firmly under a preloading clamping device, whereby the knife blade may move as necessary to seat against an anvil surface or die, the preloading mechanism being such that it will hold the blade in the "seated in" position. Thereafter, a plurality of clamp bolts can be tightened in order to secure the blade in the final "seated in" position. The mechanism provided by this invention includes a slot, or equivalent, extending longitudinally of the cutter cylinder and having opposed walls which are so arranged that clamping force may be exerted against them. One of the walls may be on, or parallel to, a radius of the cylinder, and the walls may either be parallel to each other, in which instance the wedging means may incorporate a pair of wedging surfaces, or the slot walls may be non parallel, in which instance one of such slot walls may function as an active part of the wedging mechanism. The wedging means may comprise a unitary wedge bar, used in conjunction with a slot having non-parallel walls, or such bar may be used in conjunction with an auxiliary clamp bar which is positioned between the wedge bar and blade. Alternatively, the wedge bar may have non-parallel sides which cooperate with complementary non-parallel sides of an auxiliary clamp bar.

In each event the wedge bar is supported in the slot by a plurality of bolts which extend loosely through the wedge bar, acting on the bar through intermediate spring or equivalent biasing mechanisms. These mechanisms provide a preloading force urging the wedge bar to exert the preloading or preliminary holding force, which is transferred to the blade inserted in the slot. The height of the blade is somewhat less than the depth of the slot where the blade is received. Thus, with the cutting edge of the blade extending slightly from the slot, as necessary, the opposite edge of the blade is spaced away from the bottom of the slot, such that during the "seating in" operation, the blade may be pushed into the slot against the resistance of the preloading force, to seat the cutting edge against the anvil surface. The blade is supported by resilient members when it is initially inserted, to help locate the blade away from the bottom of the slot.

To release the wedge bar, against the preloading force, for initial insertion of the blade, a jack mechanism is provided, for example, in the form of screws or bolts working against the bottom of the slot. Advancing these bolts functions as a jack to lift the wedge bar against the preloading spring force, and to hold the wedge bar in position to facilitate insertion of the blade. Spaced along the wedge bar, there are additional clamping bolts which can be tightened against seats in the wedge bar, to provide the ulitmate clamping force against the blade, after it is seated in, additive to the holding force of the preloading mechanism.

The operator, using the same wrench or tool for all operations, can release the wedge bar with the jack, insert the blade and turn in the jack sufficiently to allow the preloading force to engage and hold the blade in an initial position. Then after the cutter cylinder and the anvil or die are run in, by bringing them into engagement at inching speed, the operator can tighten the clamp bolts to maintain the blade in the ultimate seated in location.

The primary object of the invention, therefore, is to provide novel knife clamping arrangements for a rotary perforating or cutting knife, wherein a wedgeing means such as a retainer bar is provided with mechanism which exerts a retaining force sufficient to hold the blade in a mounting slot of a cutter cylinder while the blade is seated in, allowing limited movement of the knife blade in the slot to conform the knife edge to an anvil surface, together with clamping means which acts on the wedging bar to provide the ultimate tight clamping force which holds the blade in the seated location; to provide such an arrangement including resilient means for initially locating the blade in the slot; and to provide such an arrangement including jack mechanism for overcoming the retaining force on the wedging means during blade insertion.

Other objects and advantages will be apparent from the following description, the accompanying drawings and the appended claims.

DESCRIPTION OF THE PREFERRED EMBODIMENT

Figure 1:
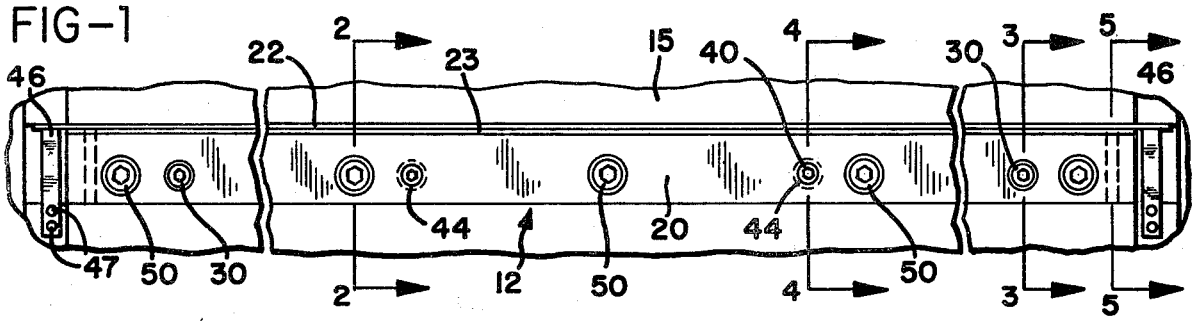
FIG. 1 is a plan view of a segment of a rotary cutter cylinder showing a blade in position next to a typical wedge bar.
Figure 2:
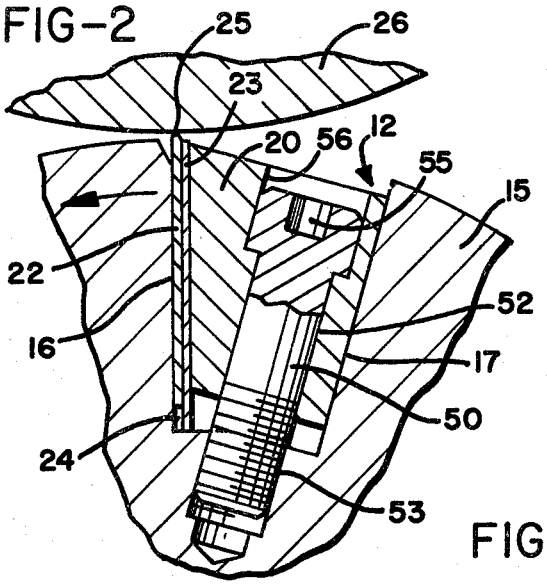
FIG. 2 is an enlarged cross-sectional view of a segment of the cutter cylinder, showing also a typical anvil surface, taken generally along line 2—2 through one of the clamping bolts in FIG. 1.
Figure 3:
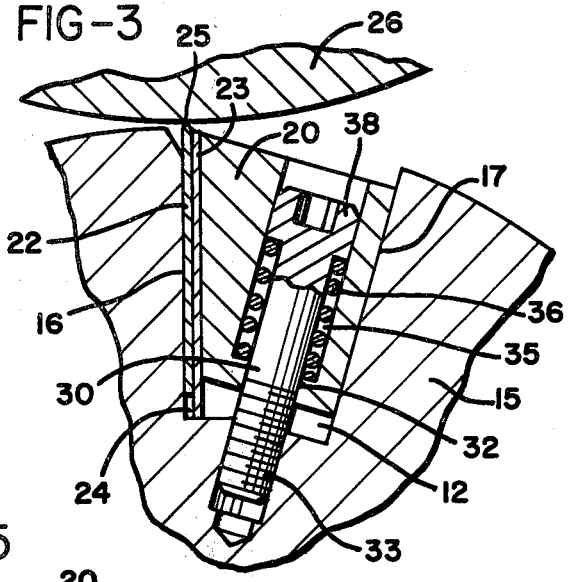
FIG. 3 is a view similar to FIG. 2 taken along line 3–3 through the retainer mechanism in FIG. 1.
Figure 4:
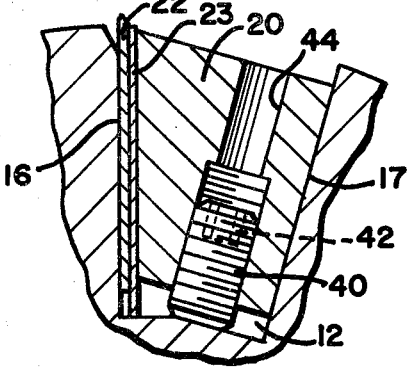
FIG. 4 is a view taken through one of the jack mechanisms on line 4—4 in FIG. 1.

FIG. 1 shows a typical blade 22 mounted in a slot 12 formed within a rotary cutter cylinder 15. As shown in FIGS. 2–4, the slot may have opposed walls 16 and 17, and these walls preferably (but not necessarily) are non-parallel, as shown, and one such wall may extend either along, or at some predetermined angle to, a radius of the cylinder. A wedge bar 20 is fitted within the slot, having walls which are complementary, generally, to the walls 16 and 17, the bar acting to hold a perforating or cutting blade 22 against the wall 16, as shown, through an intermediate or buffer plate 23. It should be noted that the depth of the slot 12 is sufficiently greater than the width of blade 22 that a space 24 remains below the edge of blade 22 opposite the cutting edge 25, whereby there is room for the blade to be pushed into the slot as the blade is seated against the anvil 26 during the "seating in" operation as is well known. Plate 23, however, extends the full depth of slot 12, abutting the bottom, but does not project out of the slot.

Figure 5:
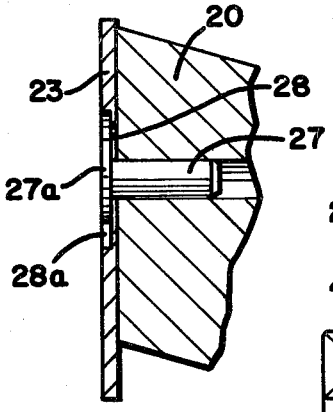
FIG. 5 is an enlarged cross-sectional view showing a retainer pin holding the buffer plate to the wedge bar.
Figure 6:
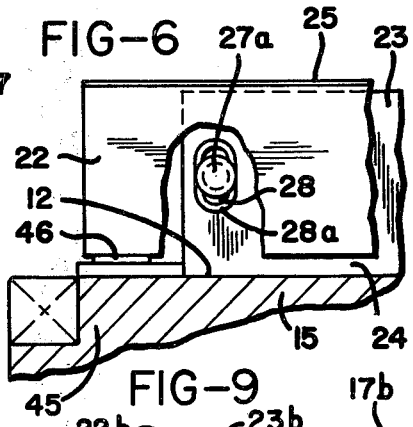
FIG. 6 is a partial view of the end of the blade, of the buffer plate, and of a blade positioning spring at one end of the cylinders.

Plate 23 is loosely retained to the bar 20 by a pair of pins 27 (FIGS. 5 and 6) which extend through elongated slots 28 in the plate 23 and fit into appropriate holes in the bar. The pins have enlarged heads **27*a* that fit within recesses 28*a* around the slots 28, allowing the buffer plate to seat smoothly against the blade 22, yet permit limited relative movement between plate 23 and bar 20** during releasing and clamping movements of the bar.

It should be understood that the number of retaining and clamping bolts, etc., is merely exemplary, and will depend upon the particular requirements in a specified form of cutter apparatus.

In the preferred embodiment, two of the retaining bolt members are shown as preloading devices, these being the bolts 30, on opposite sides of the center of the bar 20, which extend through the bar, passing freely through a bore 32, and being threaded at 33 into the cylinder structure 15, beneath the bottom of the slot. The major part of the exposed portion of the bolt 30 is received within a counterbored part 35 within the bar, and a preloading spring 36 is located within this counterbore, acting between the head 38 of the bolt 30 and the bar 20, tending to force the bar into the slot. By reason of the non-parallel walls 16 and 17, this results in a preloading force against the blade 22, and this force can be adjusted by insertion of a tool into the socket 38 in the head of the bolt (typically a hex socket) to adjust the preload force.

In order to retract the wedge bar for insertion of a blade, a pair of spaced set screws 40, also provided with hex sockets 42, are threaded in the bar below bores 44 in the wedge bar, and act against the bottom of the slot (FIG. 4). The bores 44 provide access holes for insertion of a wrench to the hex sockets 42. By turning bolt screws inward, a jacking force is exerted to push the wedge bar 20 out of the slot, against the force of the spring 36. The operator can easily perform this jacking operation using an ordinary hex wrench. He then places a blade 22 into the slot, on the appropriate side of buffer plate, and turns the jack screws 40 out a sufficient number of turns, whereupon the preload force of the spring 36 immediately clamps the blade 22 temporarily in position.

To assist in locating the inserted blade, it is made somewhat longer than the buffer plate 23 and bar 20. The bottom of slot 12 is continued into the cylinder journal part 45, at each end, and a small leaf spring 46 is anchored by screws 47 (FIGS. 1 and 6) to extend across the extension of the slot. These springs resiliently support the bottom end edges of the blade to locate it generally prior to seating.

An additional number of clamping bolts 50 are provided, these passing through bores 52 in the wedge barand being threaded into the cylinder structure at 53, below the bottom of the slot. The heads of bolts 50 are also provided with hex sockets 55, and the heads are received within the counterbores 56, against which the bolt heads seat as the bolts are tightened to clamp the wedge bar 20 firmly in place after the blade is seated in.

The blade seating operation consists of operating the cutter mechanism, with or without a web passing through between the knife edge and anvil, preferably at inching speed through one turn, whereby the edge 25 of the blade is seated to the anvil surface (or die as the case may be) and the blade is free to move under the seating force sufficiently into the slot, at whatever locations are necessary to obtain a uniform seating of the knife edge to the anvil. The apparatus is then stopped and the operator tightens the clamp bolts 50 to secure the blade in the final seated position. The buffer plate 23 functions to transfer the force, both preloading and final clamping, from the wedge bar 20 to the blade. This arrangement prevents any slight alteration of the seated position of the blade when the wedge bar is drawn in slightly by the final tightening of the clamping bolts.

Figure 8:
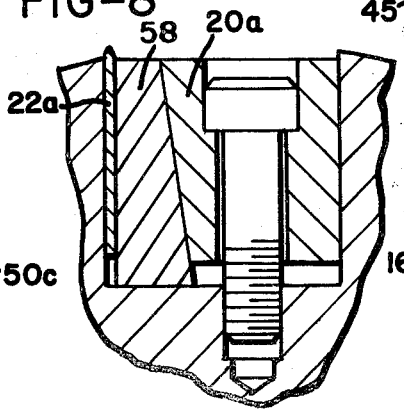
FIGS. 8 and 9 show other forms of the wedge bar and buffer plate.

FIG. 8 illustrates a modification of the invention in which a tapered intermediate clamping bar 58 is placed between a wedged shaped wedge bar **20*a* and the blade 22*a***. In this embodiment, the walls of the slot are parallel, and a wedge bar and intermediate bar have complementary sloped surfaces which interact to provide the necessary wedging action. The intermediate bar, in effect, also takes the place of the buffer plate.

Figure 9:
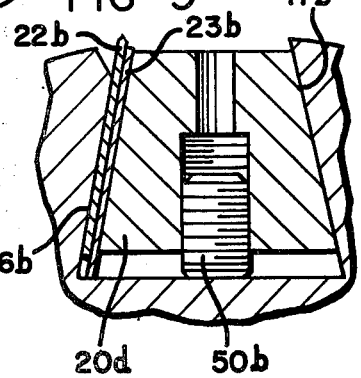

FIG. 9 shows another form of wedge bar **20*b* which acts through a buffer plate 23*b* against blade 22*b*. The walls 16*b* and 17*b* are non-parallel, extending inward of the cylinder in a diverging manner. The bar 20*b* is thus of inverted wedge shape, and the clamping screws 50*b*** act against the bottom of the slot to urge the bar upward for clamping purposes. The retaining force can in this embodiment be provided by springs (not shown) internal to some of the screws 50*b*.

Figure 7:
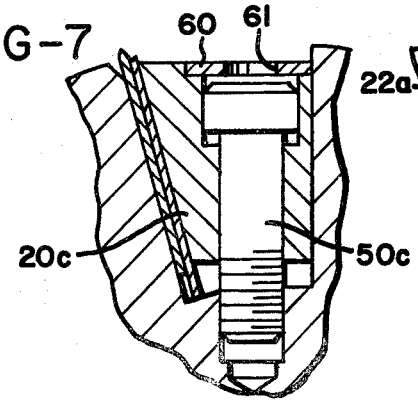
FIG. 7 is a view similar to FIG. 4 showing another form of jack mechanism.

FIG. 7 shows another form of jack mechanism, wherein one or more of bolts 50*c* have an apertured plate 60 across the bolt head, fastened to the top of bar 20*c*. A key wrench inserted through the aperture 61 can be used to rotate bolt 50*c* out, exerting an upward or releasing force on bar 20*c* through the plate 60.

While the forms of apparatus herein described constitute preferred embodiments of this invention, it is to be understood that the invention is not limited to these precise forms of apparatus, and that changes may be made therein without departing from the scope of the invention.

What is claimed is:

1. In a rotary cutter including a cutter cylinder having a web engaging surface portion and a longitudinal slot adapted to receive a knife, a knife located in said slot and having a cutting edge extending out of said slot beyond said surface portion, said knife having a width less than the depth of said slot whereby the edge of said knife opposite said cutting edge is spaced from the bottom of said slot, a wedge bar within said slot adapted to exert a force holding said knife against a side of said slot, preloading means acting on said wedge bar to retain said knife in said slot with a force sufficient to hold said knife against manual movement but which may be overcome during seating of said knife against an anvil, release means acting to move said bar outwardly of said slot against the force of said preloading means for insertion or removal of said knife, and clamping means acting on said bar additive to said preloading means to clamp the knife to said cylinder after the knife is seated.

2. A knife mounting arrangement as defined in claim 1, wherein said preloading means are spring means acting on said wedging means.

3. A knife mounting arrangement as defined in claim 2, wherein said spring means are adjustable to regulate the preloading force.

4. A knife mounting arrangement as defined in claim 1, including a jack member operable to overcome said preloading means for insertion and/or removal of a knife blade in said slot.

5. A rotary cutter as defined in claim 1, including a buffer member within said slot between said wedging means and said blade to transfer clamping force to said blade from said wedging means without disturbing the position of the blade, said buffer member being free of connection to said blade.

* * * * *